US009920460B2

(12) United States Patent
Kitagawa et al.

(10) Patent No.: US 9,920,460 B2
(45) Date of Patent: Mar. 20, 2018

(54) DOWN-PROOF WOVEN FABRIC

(75) Inventors: Tsunemitsu Kitagawa, Osaka (JP); Shintaro Kazahaya, Osaka (JP); Hiroyasu Kitajima, Fukui (JP)

(73) Assignee: Toray Industries, Inc. (JP)

( * ) Notice: Subject to any disclaimer, the term of this patent is extended or adjusted under 35 U.S.C. 154(b) by 401 days.

(21) Appl. No.: 13/378,096

(22) PCT Filed: Jun. 17, 2010

(86) PCT No.: PCT/JP2010/060282
§ 371 (c)(1),
(2), (4) Date: Apr. 3, 2012

(87) PCT Pub. No.: WO2010/147177
PCT Pub. Date: Dec. 23, 2010

(65) Prior Publication Data

US 2012/0183754 A1 Jul. 19, 2012

(30) Foreign Application Priority Data

Jun. 18, 2009 (JP) ..... 2009-145259

(51) Int. Cl.

| | |
|---|---|
| ***D06M 13/525*** | (2006.01) |
| ***D03D 15/00*** | (2006.01) |
| ***D03D 13/00*** | (2006.01) |
| ***D06N 3/00*** | (2006.01) |
| ***D06N 3/04*** | (2006.01) |
| ***D06N 3/12*** | (2006.01) |
| ***D06N 3/14*** | (2006.01) |

(52) U.S. Cl.
CPC ..... *D03D 15/00* (2013.01); *D03D 13/008* (2013.01); *D03D 15/0061* (2013.01); *D06M 13/525* (2013.01); *D06N 3/0006* (2013.01); *D06N 3/042* (2013.01); *D06N 3/128* (2013.01); *D06N 3/14* (2013.01); *D06N 2209/125* (2013.01); *D06N 2211/10* (2013.01); *D10B 2321/021* (2013.01); *D10B 2321/022* (2013.01); *D10B 2321/041* (2013.01); *D10B 2321/08* (2013.01); *D10B 2321/10* (2013.01); *D10B 2321/121* (2013.01); *D10B 2331/021* (2013.01); *D10B 2331/04* (2013.01); *D10B 2331/06* (2013.01); *D10B 2331/10* (2013.01); *D10B 2331/14* (2013.01); *D10B 2331/301* (2013.01); *D10B 2501/00* (2013.01); *Y10T 428/24942* (2015.01)

(58) Field of Classification Search
USPC ..... 442/60, 76, 79, 85, 189, 286
See application file for complete search history.

(56) References Cited

U.S. PATENT DOCUMENTS

| | | | | |
|---|---|---|---|---|
| 3,527,653 | A * | 9/1970 | Gerlach et al. | 427/246 |
| 5,273,813 | A * | 12/1993 | Akamatsu | D01F 6/62 139/420 R |
| 5,626,950 | A * | 5/1997 | Shimano et al. | 442/76 |
| 6,824,819 | B2 * | 11/2004 | Vogt | D06M 11/83 427/203 |
| 8,278,227 | B2 * | 10/2012 | Shibaoka | A45B 25/18 139/383 R |
| 2002/0098761 | A1 * | 7/2002 | Nishimoto et al. | 442/284 |
| 2007/0202763 | A1 * | 8/2007 | Shibaoka | A45B 25/18 442/203 |
| 2007/0294800 | A1 * | 12/2007 | Huang | A41D 3/00 2/97 |
| 2010/0175175 | A1 * | 7/2010 | Helwig | A41D 13/0007 2/456 |
| 2013/0035014 | A1 * | 2/2013 | Tone | D03D 13/008 442/189 |
| 2013/0312155 | A1 * | 11/2013 | Tone | D03D 1/00 2/85 |

FOREIGN PATENT DOCUMENTS

| | | | | |
|---|---|---|---|---|
| JP | 3-241078 | A | 10/1991 | |
| JP | 5-176832 | A | 7/1993 | |
| JP | 2004195968 | * | 6/2004 | B32B 5/02 |
| JP | 2004316015 | * | 11/2004 | A41D 31/00 |
| JP | 2004-339672 | A | 12/2004 | |
| JP | 2005-048298 | A | 2/2005 | |
| JP | 2005-139575 | A | 6/2005 | |
| JP | 2007-056414 | A | 3/2007 | |
| JP | 2008-81877 | * | 4/2008 | D06M 16/688 |
| JP | 2008-081877 | A | 4/2008 | |
| JP | 2008-101295 | A | 5/2008 | |
| JP | 2008101295 | * | 5/2008 | D06M 15/643 |
| WO | 2009/131207 | A1 | 10/2009 | |
| WO | WO2010140201 | A1 * | 12/2010 | D06M 15/564 |

OTHER PUBLICATIONS

Translation of JP 2008-81877. date Apr. 10, 2008.*
https://en.wikipedia.org/wiki/Waterproof_fabric. no date.*

* cited by examiner

*Primary Examiner* — Arti Singh-Pandey
(74) *Attorney, Agent, or Firm* — DLA Piper LLP (US)

(57) ABSTRACT

A down-proof woven fabric includes a cloth composed of synthetic fibers with a yarn fineness of 33 decitex or less and having a weight per unit area of 50 g/m$^2$ or less and a cover factor of 1,400 to 1,800, wherein the cloth is coated at least on one surface thereof with a resin by an amount of 0.1 g/m$^2$ to 5 g/m$^2$ as a solid component.

15 Claims, No Drawings

DOWN-PROOF WOVEN FABRIC

RELATED APPLICATIONS

This is a §371 of International Application No. PCT/JP2010/060282, with an international filing date of Jun. 17, 2010 (WO 2010/147177 A1, published Dec. 23, 2010), which is based on Japanese Patent Application No. 2009-145259, filed Jun. 18, 2009, the subject matter of which is incorporated by reference.

TECHNICAL FIELD

This disclosure relates to a light-weight down-proof woven fabric excellent in washing durability.

BACKGROUND

The woven fabric used for the outside surface or inside surface of a garment such as a down jacket or a fake down jacket is required to have a moderately low air permeability to ensure that the down or the fake down in the garment can be prevented from coming out and that the garment can be deformed to be inflated and deflated in response to the air coming in and out. To achieve a moderately low air permeability, methods of enhancing the weave density of the fabric and calendering the fabric, to compress the fibers, for lessening the inter-thread clearance are known (JP 3-241078 A, JP 2005-48298 A and JP 2004-339672 A). Further known are methods of coating or laminating a fabric with a continuously microporous film over the entire surface and a method of partially coating a fabric using a gravure roll or the like at a surface cover rate of 50 to 90% (JP 5-176832 A and JP 2007-56414 A).

The methods of controlling a low air permeability by enhancing the weave density and calendering have fundamental problems that the capability of smoothly undergoing the process is very low since yarn breaking frequently occurs and that the productivity remains low since the weaving speed is low, especially when a high-density thin woven fabric is produced by using yarns with a small fineness as required for recent down jackets. Further, even if the fabric obtained has a moderately low permeability in the initial state, it is likely to be difficult to maintain the initial low air permeability, since the inter-thread clearance is spread with the lapse of time by such forces as friction, bending and expansion/contraction in daily use accompanying folding, washing, etc. Especially a thin woven fabric composed of yarns with a small fineness is likely to increase in air permeability as time passes, and down or fake down is likely to come out. Further, if the density of the woven fabric is enhanced, the force of binding yarns together increases, causing the tear tenacity to decline, and especially in a thin woven fabric, the decline of tear tenacity is likely to pose a serious problem since the yarn tenacity is low.

On the other hand, in the method of coating or laminating the fabric with a continuously microporous film, the micropores are too small to achieve an adequate air permeability. Especially when a thin woven fabric preferred for down jackets is coated or laminated with a film, the film is likely to harden the fabric hand and to have a larger weight and, therefore, such a method is not suitable for a thin woven fabric. Further, since coating or lamination perfectly fixes the yarns in their mutual relation, the force for binding the yarns together increases as in the case of enhancing the density of the woven fabric, and the tear tenacity declines. Furthermore, according to the method of partially coating the fabric with a resin at a surface cover rate of approx. 50 to approx. 90% using a gravure roll or the like, the decline of tear tenacity and the hardening of fabric hand can be prevented while the low air permeability is maintained if the woven fabric has a medium to large thickness. However, if the woven fabric has a small thickness, the hand peculiar to the fabric may be impaired and the fabric may become heavy as in the case of full surface coating. Furthermore, a high surface cover rate can lower the tear tenacity. Therefore, it is not practical to employ this method for a thin woven fabric.

In view of these situations, it could be helpful to provide an excellent light-weight down-proof woven fabric having not only a moderately low air permeability that can prevent the down or the fake down in a garment from coming out and allows the garment to be easily deformed, i.e., inflated and deflated in response to the air coming in and out, but also the capability of preventing temporal deterioration, i.e., to inhibit the rise of air permeability, further having a practically endurable sufficient tear tenacity and not impairing the hand peculiar to the fabric.

SUMMARY

We provide a down-proof woven fabric including a cloth including synthetic fibers with a yarn fineness of 33 decitex or less having a weight per unit area of 50 g/m$^2$ or less and a cover factor of 1,400 to 1,800, wherein the cloth is coated at least on one surface thereof with a resin in an amount of 0.1 g/m$^2$ to 5 g/m$^2$ as a solid component.

We also provide clothes including the down-proof woven fabric.

We further provide bed clothes including the down-proof woven fabric.

DETAILED DESCRIPTION

We provide a down-proof woven fabric comprising a cloth composed of synthetic fibers with a yarn fineness of 33 decitex or less and having a weight per unit area of 50 g/m$^2$ or less and a cover factor of 1,400 to 1,800, wherein the aforementioned cloth is coated at least on one surface thereof with a resin by an amount of 0.1 g/m$^2$ to 5 g/m$^2$ as a solid component.

The weave is not especially limited in the down-proof woven fabric, but in view of obtaining light weight and small thickness, a plain weave such as taffeta and a modified plain weave such as rip-stop are most suitable.

Since the yarn fineness of the synthetic fibers used in the down-proof woven fabric is 33 decitex or less, the weight per unit area of the woven fabric can be easily set at 50 g/m$^2$ or less. If the yarn fineness of the synthetic fibers is made further smaller, the weight can be reduced. If the yarn fineness is 16 decitex or less, the weight per unit area of the woven fabric can be 30 g/m$^2$ or less; if 11 decitex or less, 24 g/m$^2$ or less; and if 8 decitex or less, 20 g/m$^2$ or less. If the weight per unit area of the woven fabric is more than 50 g/m$^2$, the weight of the woven fabric is too large, and the fabric cannot sufficiently exhibit the intended function as a down-proof thin woven fabric.

Further, it is preferred that the single fiber fineness of the synthetic fibers constituting at least either warp or weft yarns is 1.6 decitex or less. More preferred is 1.0 decitex or less, and further more preferred is 0.8 decitex or less. If the single fiber fineness is 1.6 decitex or less, the fibers are fine and the number of fibers increases, making the inter-fiber clearance smaller. Accordingly the impregnation of the resin into the inside of the synthetic fibers and penetration of the resin through the woven fabric onto the rear surface thereof at the time of coating are unlikely to occur, and the fabric hand cannot be impaired even after completion of coating, the low air permeability being able to be achieved. If all the synthetic fibers constituting the warp and weft yarns are more than 1.6 decitex, impregnation of the resin into the inside of the synthetic fibers and penetration of the resin through the woven fabric to the rear surface thereof at the time of coating tend to be likely to occur.

The synthetic fibers constituting the down-proof woven fabric include acrylic fibers of polymethyl methacrylate, polyacrylonitrile or the like, polyester fibers of polyethylene terephthalate, polybutylene terephthalate, polytrimethylene terephthalate or the like, polyamide fibers of nylon 6, nylon 66 or the like, polyurethane fibers, polyolefin fibers of polyethylene, polypropylene or the like, polyimide fibers, polyacetal fibers, polyether fibers, polystyrene fibers, polycarbonate fibers, polyesteramide fibers, polyphenylene sulfide fibers, polyvinyl chloride fibers, polyetherester fibers, polyvinyl acetate fibers, polyvinyl butyral fibers, polyvinylidene fluoride fibers, ethylene-vinyl acetate copolymer fibers, fluorine resin-based fibers, styrene-acrylic copolymer fibers and aramid fibers. Among them, polyamide fibers of nylon 6, nylon 66 or the like can be preferably used since they are excellent in tenacity and durability.

Further, the cover factor of the cloth is 1,400 to 1,800. Consequently an excellent down-proof woven fabric capable of effectively preventing the resin from penetrating though the woven fabric onto the rear surface thereof can be efficiently produced. On the contrary, if the cover factor of the cloth is larger than 1,800, such fundamental problems as an extremely low capability of smoothly undergoing the process and a low production speed, for example, owing to the frequent yarn breaking caused when the cloth is produced by weaving. Furthermore, the weight per unit area of the woven fabric is likely to be large, the function as a down-proof thin woven fabric cannot be sufficiently exhibited. If the cover factor is smaller than 1,400 on the contrary, the weave becomes coarse and the inter-thread clearance becomes large. Consequently, at the time coating, the resin may likely to penetrate through the fabric onto the rear surface thereof.

Moreover, the amount of the resin used for coating the cloth is 0.1 g/m$^2$ to 5 g/m$^2$ as a solid component. Therefore, since the force of binding threads together is moderately controlled, a down-proof woven fabric having adequate tear tenacity and air permeability and little seam slippage still after washing can be provided. If the coating amount of the resin is larger than 5 g/m$^2$ on the contrary, the force of binding threads together is so strong as to make it difficult to have a tear tenacity of 8 N or more, though the problem of seam slippage does not occur. Further, the resin greatly affects hardening of the hand of the thin woven fabric, and the thin woven fabric cannot sufficiently exhibit the intended function. Furthermore, since the resin fills the inter-thread clearance, the air permeability is likely to decrease to lower than 0.1 cc/cm$^2$/sec unsuitably for the down-proof thin woven fabric. If the coating amount of the resin is less than 0.1 g/m$^2$ on the contrary, the adverse influence on the hand of the thin woven fabric is small and the decrease of tear tenacity is also small. Therefore it is easy to achieve 8 N or more. However, since the adhesion between threads is insufficient, the seam slippage is likely to be larger than 2.5 mm. Furthermore, since the adhesion between threads is insufficient, the application of such forces as friction, bending and expansion/contraction makes the inter-thread clearance large, and it is difficult to keep the air permeability after washing at 1.5 cc/cm$^2$/cc or less.

Examples of the resin used for coating the down-proof woven fabric include polyurethane-based resins, polyamide-based resins, polyester-based resins, polyether-based resins, acrylic resins, vinyl chloride-based resins, fluorine-based resins, polyethylene-based resins, silicone-based resins and the like. Any one of them can be used alone or two more of them can also be used as a mixture. Further, a copolymer resin such as an acrylic silicone resin can also be used. Among them, a polyurethane-based resin is preferred since it is flexible and does not impair the fabric hand, being unlikely to wrinkle the fabric during use and after washing.

As the method for coating the cloth with a resin, a direct coating method such as floating knife method, knife-on-roll method or knife-on-bed method is preferred in view of high speed, low cost and productivity. Among the direct coating methods, especially the floating knife method allows relatively easy coating with a coating amount of 0.1 g/m$^2$ to 5 g/m$^2$.

To coat the down-proof woven fabric, it is preferred to use a dispersion (emulsion) in which a resin polymer or resin monomer, and reaction catalyst or the like are dispersed in a solvent. If a resin dispersion is used for coating, a uniform and thin resin layer can be easily formed.

For the dispersion, two types are available depending on the solvent to have a resin dispersed therein; a solvent-based resin dispersion having a resin dispersed in an organic solvent and a non-solvent-based resin dispersion having a resin dispersed in water. Either type can be used. However, a solvent-based resin dispersion is low in solid concentration and viscosity, and consequently in the case where a direct coating method is used for coating the cloth, the cloth may be perfectly closed on the surface and inside, to form an air impermeable layer as the case may be even if the coating amount of the resin is kept small, since the solvent-based resin dispersion is likely to uniformly impregnate the inside of the fabric. Therefore, even if the coating amount of the solvent-based resin dispersion is kept small to make the thickness of the resin layer small, the air permeability of the woven fabric may become less than 0.1 cc/cm$^2$/sec as the case may be. Further, since a solvent-based resin dispersion is highly compatible with the synthetic fibers constituting the cloth and is likely to impregnate the cloth, it tends to be difficult to keep the coating amount at 5 g/m$^2$ or less by a direct coating method. On the contrary, a non-solvent-based resin dispersion is higher in solid concentration than a solvent-based resin dispersion, and can be easily adjusted to have a high viscosity. Accordingly a non-solvent-based resin dispersion is unlikely to impregnate the inside of the cloth and is unlikely to form an air impermeable layer. Consequently even in the case where a direct coating method is used for coating, an air permeability of 0.1 cc/cm$^2$/cc or more can be preferably easily obtained. Furthermore, since a non-solvent-based resin dispersion is low in compatibility with the synthetic fibers constituting the cloth and is unlikely to impregnate the cloth, it is easily to keep the amount of deposition at 5 g/m$^2$ or less.

In the case where the down-proof woven fabric is coated with a non-solvent-based resin, it is preferred that the cloth is subjected to water repellency treatment and then coated with the aforementioned non-solvent-based resin dispersion at least on one surface thereof. If the cloth is subjected to water repellency treatment in advance on the surface, the cloth repels the non-solvent-based resin dispersion. Therefore, it can be easily coated with a very small amount of 0.1 g/m$^2$ to 5 g/m$^2$.

Further, it is preferred that the cloth is calendered on one surface thereof and then coated with a resin on the other surface thereof. For example, in the case where a cloth subjected to both water repellency treatment and calendering is coated, it is preferred that the cloth is coated on the non-calendered surface thereof.

In general, in the case where a direct coating method is used for coating, for example, if the cloth has a low density, the cloth may be partially impregnated with a resin and may have the resin penetrating therethrough onto the rear surface thereof during processing even if the dispersion is a non-solvent-based resin dispersion. Therefore, if the cloth is calendered before coating, to have the inter-thread clearance thereof kept small, it can be prevented that the resin penetrates through the cloth onto the rear surface thereof. However, since the calendered surface of the cloth is not rough any more and smoothened, the resin is unlikely to adhere to the woven fabric. For this reason, if the cloth is coated on the calendered surface, resin penetration through the cloth to the rear surface thereof can be powerfully prevented. However, the resin is merely deposited on the surface of the cloth, and it is difficult to achieve strong adhesion to the fabric. As a result, if such forces as friction, bending and expansion/contraction are applied at the time of washing or the like, the resin comes off, and the physical properties decline after washing and the like. On the other hand, the non-calendered surface of the cloth remains rough and consequently the adhesiveness of the resin to the woven fabric is enhanced. Therefore, if the cloth is coated with a resin on the non-calendered surface, penetration of the resin through the cloth onto the rear surface thereof can be prevented and moderate adhesiveness to the cloth can be obtained. Thus, even if such forces as friction, bending and expansion/contraction are applied at the time of washing or the like, the resin does not come off, and the changes of physical properties after washing or the like can be inhibited.

In the case where a non-solvent-based resin is used in the down-proof woven fabric, it is most preferred that the cloth is subjected to water repellency treatment, then calendered and coated with a non-solvent-based resin dispersion on the non-calendered surface of the cloth to prevent the cloth from being impregnated with the resin and the resin pentrating through the cloth onto the rear surface thereof.

Further, it is preferred that the resin coating layer is not a solid layer. A non-solid layer refers to a coating resin layer containing continuous voids. The presence of continuous voids allows an air permeability of 0.1 cc/cm$^2$/cc to be achieved easily.

The non-solid coating layer can be formed, for example, by mixing two or more types of dispersions containing a non-solvent-based hydrophilic urethane resin and a non-solvent-based water-insoluble urethane resin, coating the cloth on the surface with the mixture, and dissolving the hydrophilic urethane resin into water, to control the coating amount of the resin and to form continuous voids in the coating resin.

Further, since a woven fabric has a surface with projections and depressions at the intersection points of warp threads and weft threads, it is also preferred to use the projections and depressions, to form coated portions and non-coated portions to form a non-solid coating layer. For example, one surface of a woven fabric is coated in such a controlled manner that the coating amount and the amount of the resin impregnated into the woven fabric may be kept as small as possible and the depressions only on the surface of the cloth may be coated with the resin while the projections may not be coated with the resin to form a non-solid coating layer. As the control method for keeping the coating amount and the amount of the resin impregnated into the woven fabric as small as possible, the aforementioned method of performing water repellency treatment or calendering before coating can be preferably used.

It is preferred that the down-proof woven fabric has a tear tenacity of 8 N to 30 N. On the contrary, if the tear tenacity is less than 8 N, tear is likely to occur especially at regions requiring flexibility such as elbow portions when the fabric is worn, and when the fabric is hooked by a small projection, tear may be easily likely to occur. Further, in a woven fabric composed of synthetic fibers with a yarn fineness of 33 decitex or less, if the weave density is made small or silicone resin processing is applied to make the tear tenacity larger than 30 N, any other physical properties may be impaired such as increasing seam slippage. Therefore, it is preferred that the tear tenacity is 8 N to 30 N.

Further, since the down-proof woven fabric uses synthetic fibers with a yarn fineness of 33 decitex or less, it is preferred that the tensile tenacity is 6.0 N/decitex or more. In an ordinary woven fabric, the force of binding yarns together is higher when the woven fabric has a higher density, and therefore the tear tenacity declines. If the density is low on the contrary, the strength may become insufficient. However, if the tenacity of synthetic fibers is kept at 6.0 N/decitex or more, a tear tenacity of 8 N or more can be obtained irrespective of the density of the woven fabric.

Further, it is preferred that the down-proof woven fabric has washing durability capable of keeping an air permeability of 0.1 cc/cm$^2$/sec to 1.5 cc/cm$^2$/sec and a seam slippage of 2.5 mm or less. If the air permeability is larger than 1.5 cc/cm$^2$/sec, down is likely to come out in the final product such as a down jacket. Furthermore, in the case where the air permeability is less than 0.1 cc/cm$^2$/sec, air cannot be sufficiently removed in the production step of packing the space between the inside fabric and the outside fabric of a garment formed by sewing the down-proof woven fabric, and as a result, the space between the inside fabric and the outside fabric may not be able to be smoothly packed with down. Moreover, the final product may not be able to be easily deformed by inflating or deflating, to prevent the smooth entry and exit of air.

Further, it is preferred that seam slippage is kept at 2.5 mm or less. If the seam slippage is more than 2.5 mm, the open meshes of the woven fabric shift from a seam of a sewn portion especially in a region requiring flexibility such as an elbow portion when the garment is worn, to form a hole in the woven fabric, not allowing practical use any more. The tear tenacity is contradictory to the seam slippage. There is correlation that if the seam slippage is kept small, the tear tenacity declines and that if the seam slippage is kept large, the tear strength can be improved. Therefore, the balance between both the physical properties contradictory to each other was discussed, and as a result, it was found that a tear tenacity of 8 N or more and a seam slippage of 2.5 mm or less are adequate conditions for not causing any practical problem.

Further, the air permeability and the seam slippage are likely to be deteriorated with the passage of time, but it is preferred that the abovementioned adequate conditions are still satisfied after washing. Even if the abovementioned adequate conditions are satisfied as initial conditions, for example, before washing, a practical problem of a garment as a final product remains if the conditions are not satisfied after washing. Therefore, it is preferred that the down-proof woven fabric has washing durability capable of keeping an air permeability of 0.1 cc/cm$^2$/sec to 1.5 cc/cm$^2$ sec and a seam slippage of 2.5 mm or less.

The down-proof woven fabric can be suitably used as clothes and bedclothes, particularly as a woven fabric for clothes such as down jackets and bedclothes such as down quilts and sleeping bags.

We thus provide a down-proof woven fabric having washing durability capable of holding high tear tenacity and low air permeability by coating a cloth with 0.1 to 5 g/m$^2$ of a resin as a solid component at least on one surface thereof.

We found that if a thin woven fabric is coated with a resin by an amount smaller than a certain amount, the coating resin makes the threads adhere to each other, to obtain sufficient durability in physical properties without impairing the hand peculiar to a thin light-weight woven fabric.

That is, the cloth constituting the down-proof woven fabric is coated with a small amount of a resin. Thus, the yarns constituting the woven fabric are strongly made to adhere to each other, and washing durability capable of holding physical properties such as low air permeability can be provided.

Our woven fabrics and methods are more specifically explained below in reference to examples, but is not limited thereto or thereby.

EXAMPLES

Methods for Measuring Respective Physical Property Values and the Like (1) Air Permeability The air permeability was obtained by the method in conformity with the air permeability (Frazier method) specified in JIS L 1096, 8.27.1.

(2) Tear Tenacity

The tear tenacity was obtained by the method in conformity with the tear tenacity (single tongue method) specified in JIS L 1096, 8.15.1.

(3) Washing Treatment

Washing treatment was performed according to the test method of washing (with water) No. 103 of table 1 of JIS L 0217. Washing was performed 20 times.

(4) Cover Factor

The warp yarn density and the weft yarn density of a woven fabric were measured in a section of 2.54 cm according to JIS L 1096, 8.6.1. The cover factor value was obtained from the following formula:

Cover factor (*CF*)=Warp yarn density×(warp yarn fineness)½+Weft yarn density×(Weft yarn fineness)½.

(5) Seam Slippage

The seam slippage was obtained by the method in conformity with the seam slippage method B specified in JIS L 1096, 8.21.1.

Example 1

A woven fabric with a weave density of 155 warp yarns/2.54 cm and 142 weft yarns/2.54 cm, each of warp and weft yarns having a fineness of 33 decitex and consisting of twenty six N66 filaments, was immersed in an aqueous solution containing 1% of a fluorine-based water repellent "Asahi Guard AG970" (Meisei Chemical Works, Ltd.), mangled, dried at 100° C. for 1 minute, heat-set at 170° C. for 1 minute, calendered at 170° C. at 35 t (160 cm), coated with a resin dispersion obtained by mixing 90 parts of a non-solvent-based urethane resin "Parazol PNA-284" (Ohara Paragium Chemical Co., Ltd.), 3 parts of a crosslinking agent "Paracat PEG" and 7 parts of a softening agent "AYL-50E (Ohara Paragium Chemical Co., Ltd.) on the non-calendered surface using a floating knife, dried at 120° C. for 1 minute, and heat-set at 170° C. for 1 minute.

Example 2

A woven fabric with a weave density of 210 warp yarns/2.54 cm and 142 weft yarns/2.54 cm, each warp yarn having a fineness of 17 decitex and consisting of seven N66 filaments and each weft yarn having a fineness of 33 decitex and consisting of twenty six N66 filaments, was treated by a water repellent and coated as described in Example 1.

Example 3

A woven fabric with a weave density of 209 warp yarns/2.54 cm and 184 weft yarns/2.54 cm, each of warp and weft yarns having a fineness of 16 decitex and consisting of six N66 filaments, was treated by a water repellent and coated as described in Example 1.

Example 4

A woven fabric with a weave density of 155 warp yarns/2.54 cm and 142 weft yarns/2.54 cm, each of warp and weft yarns having a fineness of 33 decitex and consisting of twenty six N66 filaments, was immersed in an aqueous solution containing 1% of a fluorine-based water repellent "Asahi Guard AG970" (Meisei Chemical Works, Ltd.), mangled, dried at 100° C. for 1 hour, heat-set at 170° C. for 1 minute, calendered at 170° C. at 35 t (160 cm), coated with a resin dispersion obtained by mixing 30 parts of a non-solvent-based urethane resin "Parazol PN-20" (Ohara Paragium Chemical Co., Ltd.), 50 parts of a non-solvent-based hydrophilic urethane resin "Paramillion AF-50 (Ohara Paragium Chemical Co., Ltd.) and 3 parts of a crosslinking agent "Paracat PGW-4" (Ohara Paragium Chemical Co., Ltd.) on the non-calendered surface by a knife-on-roll method and dried at 170° C. for 1 minute. It was subjected to water washing treatment using an open soaper, to remove the non-solvent-based hydrophilic urethane resin "Paramillion AF-50," then dried at 120° C. for 1 minute and heat-set at 170° C. for 1 minute.

Example 5

A woven fabric with a weave density of 243 warp yarns/2.54 cm and 225 weft yarns/2.54 cm, each warp yarn having a fineness of 11 decitex and consisting of 10 filaments and each weft yarn having a fineness of 8 decitex and consisting of five N66 filaments, was treated by a water repellent and coated as described in Example 4.

Example 6

A woven fabric with a weave density of 220 warp yarns/2.54 cm and 195 weft yarns/2.54 cm, each of warp and weft yarns having a fineness of 11 decitex and consisting of eight N66 filaments was treated by a water repellent and coated as described in Example 4.

Example 7

The same woven fabric as used in Example 4 was treated by a water repellent and calendered as described in Example 4, and then coated with a non-solvent-based acrylic resin "Newcoat FH-45" (Shin-Nakamura Chemical Co., Ltd.) on the non-calendered surface using a floating knife, dried at 120° C. for 1 minute, and heat-set at 170° C. for 1 min.

Example 8

The same woven fabric as used in Example 4 (not yet treated by a water repellent) was calendered at 170° C. at 35 t (160 cm). The fabric was coated with a mixture consisting of 100 parts of a solvent-based acrylic resin "Pancron AM-200" (Negami Kogyo Co., Ltd.) and 2 parts of a crosslinking agent "Pancron LN" on the non-calendered surface using a floating knife, and dried and heat-set at 130° C. for 1 minute.

Example 9

The same woven fabric as used in Example 4 (not yet treated by a water repellent) was calendered at 170° C. at 35 t (160 cm). The fabric was coated with a mixture obtained by mixing 100 parts of a solvent-based silicone resin "Paracron PE-30" (Negami Kogyo Co., Ltd.) and 2 parts of a crosslinking agent "Catalyst C46" on the non-calendered surface using a floating knife, and dried and heat-set at 130° C. for 1 minute.

Comparative Example 1

The same woven fabric as used in Example 1 was not coated.

Comparative Example 2

The same woven fabric as used in Example 2 was not coated.

Comparative Example 3

The same woven fabric as used in Example 3 was not coated.

Comparative Example 4

The same woven fabric as used in Example 5 was not coated.

Comparative Example 5

The same woven fabric as used in Example 6 was not coated.

The results of measuring the respective physical values of the woven fabrics of the examples and comparative examples are shown in Table 1.

TABLE 1

| | Yarn fineness (decitex) | | Single fiber fineness (decitex) | | Coating amount of resin (solid content) | Weight per unit area | Cover | Air permeability (cc/cm²/sec) | | Seam slippage (mm) Warp | | Seam slippage (mm) Weft | | Tear tenacity (N) | |
|---|---|---|---|---|---|---|---|---|---|---|---|---|---|---|---|
| | Warp | Weft | Warp | Weft | (g/m²) | (g/m²) | factor | Initial | After washing | Initial | After washing | Initial | After washing | Warp | Weft |
| Example 1 | 33 | 33 | 1.27 | 1.27 | 1 | 42 | 1706 | 0.3 | 0.3 | 1.3 | 1.6 | 1.1 | 1.4 | 10.9 | 9.1 |
| Example 2 | 17 | 33 | 2.43 | 1.27 | 2 | 36 | 1682 | 0.2 | 0.4 | 1.5 | 1.7 | 1.7 | 1.8 | 19.6 | 22.4 |
| Example 3 | 16 | 16 | 2.67 | 2.67 | 3 | 27 | 1572 | 0.3 | 0.5 | 1.7 | 1.9 | 1.4 | 1.5 | 9.1 | 8.1 |
| Example 4 | 33 | 33 | 1.27 | 1.27 | 1 | 41.5 | 1706 | 0.3 | 0.5 | 1.3 | 1.7 | 1.1 | 1.5 | 11.8 | 9.8 |
| Example 5 | 11 | 8 | 1.1 | 1.6 | 1 | 25.7 | 1433 | 0.4 | 0.4 | 2.0 | 1.6 | 1.3 | 1.4 | 10.1 | 10.5 |
| Example 6 | 11 | 11 | 1.375 | 1.375 | 1 | 28.4 | 1376 | 0.2 | 0.3 | 1.8 | 1.6 | 1.9 | 1.5 | 12.3 | 15.7 |
| Example 7 | 33 | 33 | 1.27 | 1.27 | 1 | 41.5 | 1706 | 0.2 | 0.4 | 1.3 | 1.5 | 1.1 | 1.3 | 10.5 | 8.9 |
| Example 8 | 33 | 33 | 1.27 | 1.27 | 5 | 46 | 1706 | 0.1 | 0.1 | 1.0 | 1.3 | 0.8 | 1.0 | 8.6 | 8.0 |
| Example 9 | 33 | 33 | 1.27 | 1.27 | 5 | 46 | 1706 | 0.1 | 0.1 | 1.2 | 1.5 | 1.0 | 1.2 | 8.8 | 8.0 |
| Comparative Example 1 | 33 | 33 | 1.27 | 1.27 | 0 | 41 | 1706 | 0.4 | 1.3 | 1.4 | 2.4 | 1.1 | 1.8 | 12.3 | 10.3 |
| Comparative Example 2 | 17 | 33 | 2.43 | 1.27 | 0 | 34 | 1682 | 0.8 | 2.8 | 2.3 | 2.5 | 1.2 | 1.6 | 20.6 | 29.4 |
| Comparative Example 3 | 16 | 16 | 2.67 | 2.67 | 0 | 24 | 1572 | 10.1 | 12.5 | 4.4 | 6.0 | 1.2 | 1.5 | 11.1 | 9.8 |
| Comparative Example 4 | 11 | 8 | 1.1 | 1.6 | 0 | 24.7 | 1433 | 0.6 | 1.4 | 2.9 | 3.4 | 1.8 | 2.2 | 11.3 | 10.3 |
| Comparative Example 5 | 11 | 11 | 1.375 | 1.375 | 0 | 27.4 | 1376 | 1 | 1.8 | 2.4 | 3.0 | 2.0 | 2.3 | 11.8 | 15.7 |

From Table 1, it can be seen that the woven fabrics of Examples 1 to 9 are very small in the aggravation of air permeability and seam slippage after washing. Further, the woven fabrics of Examples 1 to 9 are light in weight and good in fabric hand, showing good results of measurement even compared with the non-coated woven fabrics.

Further, since the woven fabrics of Examples 1 to 9 are coated, they decline in tear tenacity as a matter of course, but still have practically adequate tear tenacity values by keeping the coating amount extremely small.

INDUSTRIAL APPLICABILITY

The down-proof woven fabric of this invention can be suitably used as a woven fabric for clothes such as down jackets.

The invention claimed is:

1. A down-proof woven fabric comprising a cloth consisting of synthetic fibers consisting of polymeric resin with a yarn fineness of 33 decitex or less, a weight per unit area of 50 $g/m^2$ or less and a cover factor of 1,400 to 1,800, wherein the cloth is coated at least on one surface thereof with a resin in an amount of 0.1 $g/m^2$ to 5 $g/m^2$ as a solid component to form a non-solid layer and the non-solid layer contains continuous voids, the cloth is calendered at least on one surface thereof, and subsequently coated with the resin on another surface thereof.

2. The down-proof woven fabric according to claim 1, wherein the resin is a urethane resin.

3. The down-proof woven fabric according to claim 2, wherein the resin is a non-solvent-based resin.

4. The down-proof woven fabric according to claim 2, wherein the cloth is subjected to water repellent treatment and subsequently coated with the resin on at least one surface thereof.

5. The down-proof woven fabric according to claim 2, which has a tear tenacity of 8 N to 30 N.

6. The down-proof woven fabric according to claim 1, wherein the resin is a non-solvent-based resin.

7. The down-proof woven fabric according to claim 6, wherein the cloth is subjected to water repellent treatment and subsequently coated with the resin on at least one surface thereof.

8. The down-proof woven fabric according to claim 6, which has a tear tenacity of 8 N to 30 N.

9. The down-proof woven fabric according to claim 1, wherein the cloth is subjected to water repellent treatment and subsequently coated with the resin on at least one surface thereof.

10. The down-proof woven fabric according to claim 9, which has a tear tenacity of 8 N to 30 N.

11. The down-proof woven fabric according to claim 1, which has a tear tenacity of 8 N to 30 N.

12. The down-proof woven fabric according to claim 1, which has washing durability capable of holding an air permeability of 0.1 $cc/cm^2/sec$ to 1.5 $cc/cm^2/sec$ and a seam slippage of 2.5 mm or less.

13. An article of clothing comprising the down-proof woven fabric set forth in claim 1.

14. An article of bed clothing comprising the down-proof woven fabric set forth in claim 1.

15. A down-proof woven fabric comprising a cloth consisting of synthetic fibers consisting of polymeric resin with a yarn fineness of 33 decitex or less, a weight per unit area of 50 $g/m^2$ or less and a cover factor of 1,400 to 1,800, wherein the cloth is coated at least on one surface thereof with a resin in an amount of 0.1 $g/m^2$ to 5 $g/m^2$ as a solid component and then dried to form a non-solid layer and the non-solid layer contains continuous voids, the cloth is calendered at least on one surface thereof, and subsequently coated with the resin on another surface thereof.

* * * * *